US005645333A

United States Patent [19]

Sakurai

[11] Patent Number: 5,645,333

[45] Date of Patent: Jul. 8, 1997

[54] OVERHEAD DOOR

[75] Inventor: Masanori Sakurai, Tokyo, Japan

[73] Assignee: Sugatsune Industrial Co., Ltd., Tokyo, Japan

[21] Appl. No.: 422,960

[22] Filed: Apr. 17, 1995

[30] Foreign Application Priority Data

Apr. 15, 1994 [JP] Japan ..... 6-102333

[51] Int. Cl.[6] ..... A47B 67/02; A47F 3/00

[52] U.S. Cl. ..... 312/322; 312/319.2; 16/DIG. 9

[58] Field of Search ..... 47/197; 312/323, 312/322, 321.5, 307, 319.4, 319.1, 219, 107.5, 245; 16/51, 52, DIG. 9

[56] References Cited

U.S. PATENT DOCUMENTS

| | | | |
|---|---|---|---|
| Re. 28,994 | 10/1976 | Aylworth | 312/245 |
| 4,938,322 | 7/1990 | Sugasawara et al. | 16/51 X |
| 5,079,797 | 1/1992 | Ohshima et al. | 16/DIG. 9 |
| 5,353,899 | 10/1994 | Ohshima | 188/310 |
| 5,399,010 | 3/1995 | McClung et al. | 312/322 X |
| 5,409,308 | 4/1995 | Reuter et al. | 312/319.4 |
| 5,458,412 | 10/1995 | Lee et al. | 312/319.2 X |

*Primary Examiner*—Peter M. Cuomo
*Assistant Examiner*—Robert J. Sandy
*Attorney, Agent, or Firm*—Jacobson, Price, Holman & Stern, PLLC

[57] ABSTRACT

There is provided an overhead door that is placed on the roof board of a cabinet or the like to which it is fitted when it is opened so that the space available within the cabinet may be maximized. The overhead door 8 is swingably secured to the inner lateral wall surfaces 4, 4 of the cabinet 1 by means of a pair of support arms 14, 14 such that the distal end of each of the support arms is rotatably secured to a rotary shafts 15 on the corresponding lateral wall of the cabinet and the proximal end is pivotably fitted to the inner surface of teh door at a position close to the lower edge thereof by way of a bracket 16. The door 8 is provided on the inner surface thereof with a pair of longitudinally arranged slide rail assemblies 9, 9, each comprising a relatively long outer rail 9*c* and a relatively short inner rail 9*d* arranged vis-a-vis the outer rail and pivotably secured at the upper end to the front edge of the roof wall 2 of the cabinet 1 by means of a hinge 14 comprising hinge bodies 10*a*, 10*b* and an axis 10*c*. Thus, the door 8 can be swung closed as a combined effect of slewing and sliding motions when it is pulled forward and downward from its fully open position located on the roof board 2.

5 Claims, 4 Drawing Sheets

OVERHEAD DOOR

BACKGROUND OF THE INVENTION

1. [Field of the Invention]

This invention relates to an overhead door suspended from the top of an opening of a cabinet or the like and capable of being lifted until it is placed on the roof wall of the cabinet to keep the door open.

2. [Prior Art]

FIG. 5 of the accompanying drawing illustrates a known overhead door a designed to be lifted and placed under the roof wall c of a cabinet b (Japanese Utility Model Application No. 60-18528).

A know overhead door of the above described type is, however, accompanied by a number of drawbacks including that it has a rather complicated configuration of comprising a support rod d and a short rod e arranged for swinging the door a up and down as well as a spring f fitted thereto, that a slide assembly constituted by a slide rail g and a door wheel h is arranged within the cabinet to make it rather cumbersome to secure the door a to a cabinet b and positionally adjust the door a once it has been secured to the cabinet b and that the space available within the cabinet b is limited because it has to accommodate the door a within it.

Additionally, when the door a is opened, the cabinet becomes esthetically unattractive because of the exposed support rod d and spring f and, during the operation of opening or closing the door, the finger of the user operating the door may be accidentally caught and pinched by the spring f or between the spring f and the support rod d.

In view of the above identified problems and other problems of known overhead door of the type under consideration, it is therefore an object of the invention to provide an overhead door of a cabinet or the like provided with a set of appropriately dimensioned attachments including support arms and slide rails fitted to a cabinet such that the overhead door is placed on the roof wall of the cabinet as it is swung open and the door and attachments do not constitute any obstacles for the operation of storing and retrieving objects in and from the cabinet.

For the purpose of the invention, a number of tension springs may preferably be arranged in respective grooves on the inner surface of the door such that they may not be moved away from the door when the latter is swung open or closed to eliminate the danger of pinching a finger and they may decelerate the speed and lessen the load with which the door is swung open or closed.

Alternatively, the door may be movably held to the adjacent lateral walls of the cabinet not simply by means of respective support arms but by way of a damper disposed between the distal end of each of the support arms and the related lateral wall so that, when the door is closed from the open position where it is located on the roof wall, it is moved only slowly and softly due to the resistance or the damping effect of the damper against the torque of the door produced by its load.

Still preferably, an overhead door according to the invention may be provided with a combination of dampers and tension springs arranged at appropriate locations so that both the braking force of the dampers and the restoring force of the expanded springs may be exploited to decelerate the speed and lessen the load with which the door is swung open or closed and consequently no substantial effort is required for the user to open or close the door.

Alternatively, an overhead door according to the invention may be provided with a combination of dampers and coil springs arranged at appropriate locations so that both the braking force of the dampers and the restoring force of the coil springs may be exploited to decelerate the speed an lessen the load with which the door is swung open or closed and consequently no substantial effort is required for the user to open or close the door.

Still alternatively, an overhead door according to the invention may be provided with a combination of dampers, tension springs and coil springs arranged at appropriate locations so that all the braking force of the dampers, the restoring force of the expanded tension springs and the coil springs may be fully exploited to further decelerate the speed and lessen the load with which the door is swung open or closed and consequently no substantial effort is required for the user to open or close the door.

SUMMARY OF THE INVENTION

According to the invention, the above object is achieved by provided an overhead door swingably secured to the inner lateral wall surfaces of a cabinet or the like by means of a pair of support arms such that the distal end of each of the support arms is rotatably secured to the corresponding lateral wall of the cabinet and the proximal end is pivotably fitted to the inner surface of the door at a position close to the lower edge thereof, characterized in that is is provided on the inner surface thereof with a pair of longitudinally arranged slide rail assemblies, each comprising a relatively long outer rail and a relatively short inner rail arranged vis-a-vis the outer rail with a ball retainer interposed therebetween and pivotably secured at the upper end to the front end of the roof wall of the cabinet, so that the door can be swung open or closed as a combined effect of slewing and sliding motions and, when fully opened, it is placed on the roof wall of the cabinet.

An overhead door as described above can be easily swung open by hand from its suspended closed position when it is moved forward and upward at the lower end thereof to rotate the support arms around their respective pivots on the lateral walls.

As the door and the support arms are moved upward until the pivots of the arms on the door are located above their pivots on the side walls of the cabinet, the outer rail slides upward and with the door relative to the inner rail and rotates until eventually the door is fully opened and placed horizontally on the roof wall of the cabinet because of the arrangement that the inner rail is rotatably hinged to the front edge of the roof wall of the cabinet.

For closing the door, it is simply necessary to pull the front edge of the door forward by hand from its fully opened position and then downward to rotate the slide rail assemblies around their respective hinges and also the support arms of the door around the respective pivots on the side walls of the cabinet. Note that, when the door is rotated by a given angle, it automatically rotates on and move downward to its closed position due to the torque applied to its by its own weight.

According to the invention, there is also provided an overhead door swingably secured to the inner lateral wall surfaces of a cabinet or the like by means of a pair of support arms such that the distal end of each of the support arms is rotatably secured to the corresponding lateral wall of the cabinet and the proximal end is pivotably fitted to the inner surface of the door at a position close to the lower edge thereof, characterized in that it is provided on the inner surface thereof with a pair of longitudinally arranged slide rail assemblies, each comprising a relatively long outer rail and a short inner rail arranged vis-a-vis the outer rail with a ball retainer interposed therebetween and pivotably secured at the upper end to the front edge of the roof wall of the cabinet, so that the door can be swung open or closed as a combined effect of slewing and sliding motions and, when fully opened, it is placed on the roof wall of the cabinet and that it is also provided on the inner surface thereof with a number of longitudinal grooves, each accommodating a tension spring having an end hooked to the upper end of corresponding one of the hinges and the other end hooked to the lower end of the groove, so that the upward motion of the outer rail and the door relative to the inner rail is restrained whereas their downward motion is facilitated by the tension springs.

Since an overhead door as described above is additionally provided with tension springs, it is subjected to a torque that urges it to rotate and move upward when it is moved forward and upward at the lower end thereof to rotate the support arms around their respective pivots on the lateral walls until the pivots of the arms on the door are located above their pivots on the side walls of the cabinet. Then, the outer rail slides upward and with the door relative to the inner rail and rotates until eventually the door is fully opened and placed horizontally on the roof wall of the cabinet because of the arrangement that the inner rail is rotatably hinged to the front edge of the roof wall of the cabinet.

Note that the door is securely held to its open position located on the roof wall of the cabinet, if it is released from the hand holding it because of the force applied to it by tension springs to urge it backward.

For closing the door, it is simply necessary to pull the front edge of the door forward by hand from its fully opened position against the force of the tension springs urging the door backward and then pull it downward to rotate the slide rail assemblies around their respective hinges and also the support arms of the door around the respective pivots on the side walls of the cabinet. Note that, when the door is rotated by a given angle, it automatically rotates on and moves downward to its closed position due to the torque applied to its by its own weight. Also note that, as the door is closed, the tension springs are extended and store energy that can be exploited to pull up the door in the next door opening operation.

According to the invention, there is also provided an overhead door swingable secured to the inner wall surfaces of a cabinet or the like by means of a pair of support arm/damper assemblies such that the damper of each of the assemblies is rigidly fitted to the corresponding lateral wall of the cabinet and the distal end of the support arms of the assembly is secured to the rotary shaft of the damper while the proximal end is pivotably fitted to the inner surface of the door at a position close to the lower edge thereof, characterized in that it is provided on the inner surface thereof with a pair of longitudinally arranged slide rail assemblies, each comprising a relatively long outer rail and a short inner rail arranged vis-a-vis the outer rail with a ball retainer interposed therebetween and pivotably secured at the upper end to the front edge of the roof wall of the cabinet, so that the door can be swung open or closed as a combined effect of slewing and sliding motions and, when fully opened, it is placed on the roof wall of the cabinet.

With the above described arrangement, since the distal end of the support arm of each of the support arm/damper assemblies is not directly fitted to a lateral wall of the cabinet but fitted to the lateral wall by way of a damper, the latter does not exert any resistance against the door moving upward to its open position although the rotary shaft of the damper rotates. Consequently, the door moves smoothly until it gets to its fully opened position on the roof wall of the cabinet.

When, to the contrary, the door is closed, the rotary shaft and an inner sleeve of the damper are reversely rotated relative to the damper main body to alleviate the torque applied to the door so that the door moves lightly and slowly until it gets to its suspended and fully closed position.

According to the invention, there is also provided an overhead door swingably secured to the inner lateral wall surfaces of a cabinet or the like by means of a pair of support arm/damper assemblies such that the damper of each of the assemblies is rigidly fitted to the corresponding lateral wall of the cabinet and the distal end of the support arms of the assembly is secured to the rotary shaft of the damper while the proximal end is pivotably fitted to the inner surface of the door at a position close to the lower edge thereof, characterized in that it is provided on the inner surface thereof with a pair of longitudinally arranged slide rail assemblies, each comprising a relatively long outer rail and a short inner rail arranged vis-a-vis the outer rail with a ball retainer interposed therebetween and pivotably secured at the upper end to the front edge of the roof wall of the cabinet, so that the door can be swung open or closed as a combined effect of slewing and sliding motions and, when fully opened, it is placed on the roof wall of the cabinet and that it is also provided on the inner surface thereof with a number of longitudinal grooves, each accommodating a tension spring having an end hooked to the upper end of corresponding one of the hinges and the other end hooked to the lower end of the groove, so that the upward motion of the outer rail and the door relative to the inner rail is restrained whereas their downward motion is facilitated by the tension springs.

With the above described arrangement where the door is provided with tension springs and dampers, the dampers do not exert any resistance against the door moving upward toward its open position and the tension springs that have been expanded urge the door to move upward due to their restoring force until the door gets to its fully opened position.

When, to the contrary, the door is closed, the rotary shaft and an inner sleeve of the damper are reversely rotated relative to the damper main body to alleviate the torque applied to the door so that the door moves lightly and slowing until it gets to its suspended and fully closed position. Additionally, since the tension springs exert resistance against the door, the downward movement of the latter is made to be very smooth, slow and reliable if the door is very heavy.

According to the invention, there is also provided an overhead door swingably secured to the inner lateral wall surface of a cabinet or the like by means of a pair of support arm/damper assemblies such that the damper of each of the assemblies is rigidly fitted to the corresponding lateral wall of the cabinet and the distal end of the support arms of the assembly is secured to the rotary shaft of the damper while the proximal end is pivotably fitted to the inner surface of the door at a position close to the lower edge thereof, characterized in that it is provided on the inner surface thereof with a pair of longitudinally arranged slide rail assemblies, each comprising a relatively long outer rail and a short inner rail arranged vis-a-vis the outer rail with a ball retainer interposed therebetween and pivotably secured at the upper end to the front edge of the roof wall of the cabinet, so that the door can be swung open or closed as a combined effect of slewing and sliding motions and, when fully opened, it is placed on the roof wall of the cabinet and that the camper of each of said short arm/damper assemblies is provided with a coil spring having an end hooked to the rotary shaft of the damper and the other end hooked to the damper main body so that it is wound further when the door is moved down toward its closed position and urges the outer rail and the door upward relative to the inner rail.

With the above described arrangement where the door is provided with coil springs and dampers, the dampers do not exert any resistance against the door moving upward toward its open position and the coil springs that have been wound in previous closing operation urge the door to move upward due to their restoring force until the door gets to its fully opened position.

When, to the contrary, the door is closed, the rotary shaft and an inner sleeve of the damper are reversely rotated relative to the damper main body to alleviate the torque applied to the door so that the door moves lightly and slowing until it gets to its suspended and fully closed position. Additionally, since the coil springs that are being wound exert resistance against the door, the downward movement of the latter is made to be very smooth, slow and reliable if it is very heavy.

According to the invention, there is also provided an overhead door swingably secured to the inner lateral wall surfaces of a cabinet or the like by means of a pair of support arm/damper assemblies such that the damper of each of the assemblies is rigidly fitted to the corresponding lateral all of the cabinet and the distal end of the support arms of the assembly is secured to the rotary shaft of the damper while the proximal end is pivotably fitted to the inner surface of the door at a position close to the lower edge thereof, characterized in that it is provided on the inner surface thereof with a pair of longitudinally arranged slide rail assemblies, each comprising a relatively long outer rail and a short inner rail arranged vis-a-vis the outer rail with a ball retainer interposed therebetween an pivotably secured at the upper end to the front edge of the roof wall of the cabinet, so that the door can be swung open or closed as a combined effect of slewing and sliding motions and, when fully opened, it is placed on the roof wall of the cabinet, that it is also provided on the inner surface thereof with a number of longitudinal grooves, each accommodating a tension spring having an end hooked to the upper end of corresponding one of the hinges and the other end hooked to the lower end of the groove, so that the upward motion of the outer rail and the door relative to the inner rail is restrained, whereas their downward motion is facilitated by the tension springs and the damper of each of said short arm/damper assemblies is provided with a coil spring having an end hooked to the rotary shaft of the damper and the other end hooked to the damper main body so that it is wound further when the door is moved down toward its closed position and urges the outer rail and the door upward relative to the inner rail.

With the above described arrangement where the door is provided with dampers, tension springs and coil springs the dampers do not exert any resistance against the door moving upward toward its open position and the coil springs that have been wound in the previous closing operation urge the door to move upward due to their restoring force until the door gets to its fully opened position in addition to the urging effect of the tension springs.

When, to the contrary, the door is closed, the rotary shaft and an inner sleeve of the damper are reversely rotated relative to the damper main body to alleviate the torque applied to the door so that the door moves lightly and slowly until it gets to its suspended and fully closed position. Additionally, since the coil springs that are being wound and the tension springs that are being expanded exert resistance against the door in a concerted manner, the downward movement of the latter is made to be very smooth, slow and reliable if it is very heavy.

Now, the present invention will be described in greater detail by referring to the accompanying drawings that illustrate preferred embodiments of the invention.

DETAILED DESCRIPTION OF THE INVENTION

Figure 1:
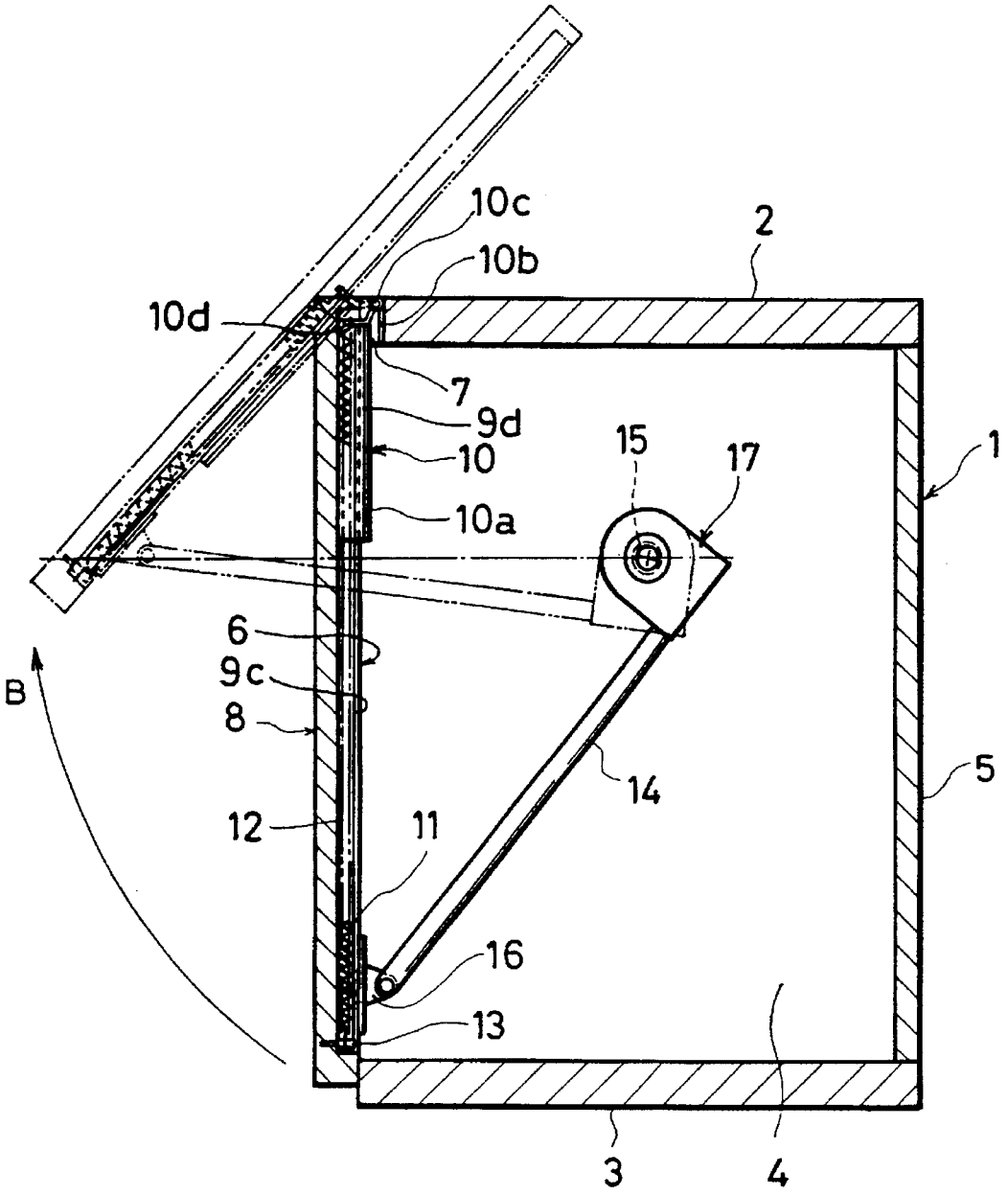
FIG. 1 is a longitudinal sectional view of an embodiment of overhead door according to the invention and fitted to a cabinet, the door being shown both in a closed position and in an intermediate position.
Figure 2:
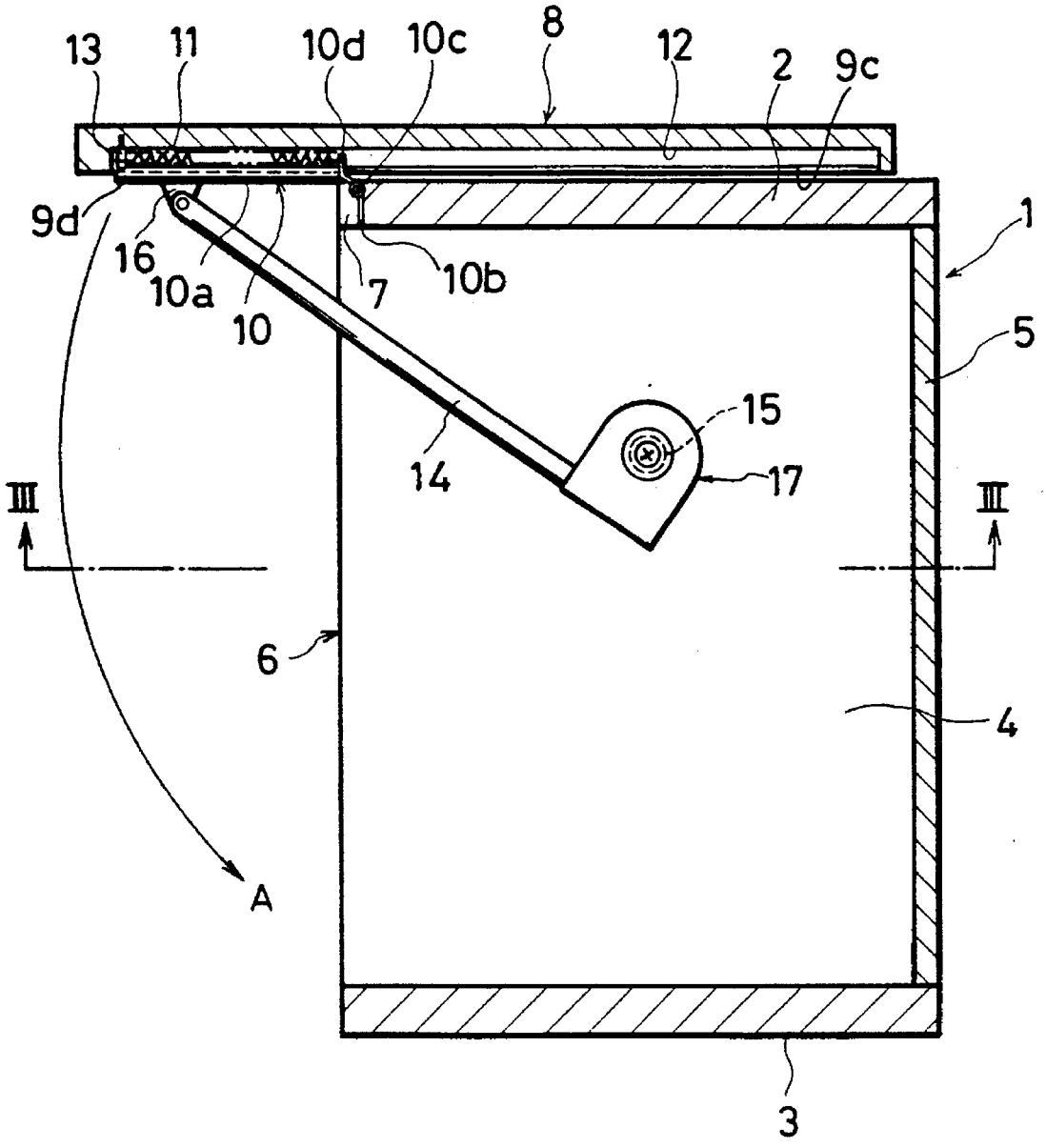
FIG. 2 is a longitudinal sectional view similar to FIG. 1 but showing the door in a fully opened position located on the roof wall of the cabinet, it being a view taken along line II—II in FIG. 3.
Figure 3:
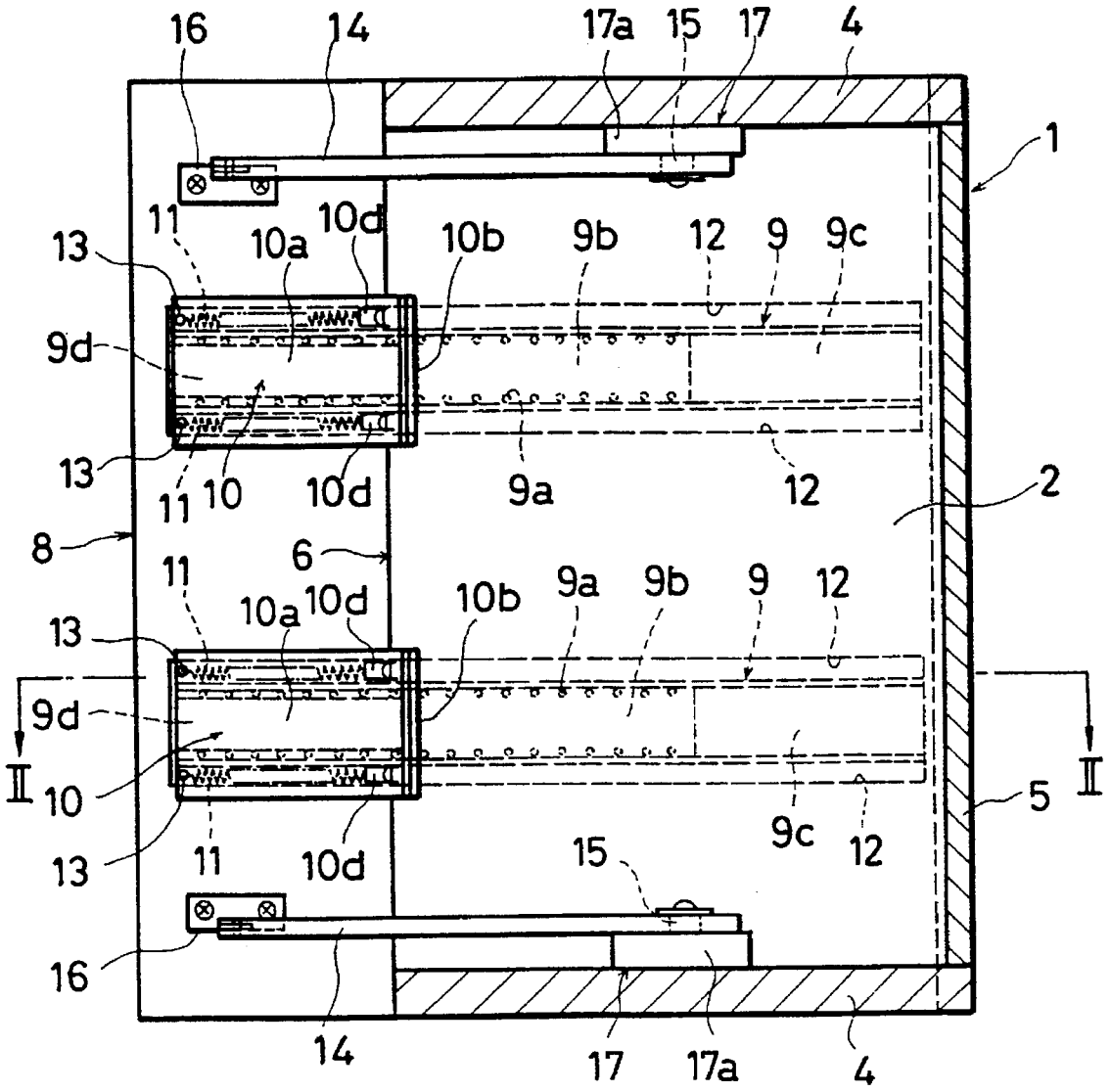
FIG. 3 is a sectional view of the embodiment of FIG. 2 taken along line III—III.

Referring firstly to FIGS. 1 through 3, there is shown a cabinet 1 comprising a roof wall 2, a bottom wall 3, a pair of lateral walls 4 and a rear wall 5 to produce an opening 6 on the front side thereof, recesses being formed on the roof wall 2 along the front edge thereof for receiving hinges 10, which will be described further hereinafter.

A door 8 made of a thick panel is dimensioned so as to completely cover the opening 6 and the surrounding walls if viewed from the front side and provided on the inner surface with a pair of slide rail assemblies running longitudinally, said slide rail assemblies being held to the door 8 by rigidly securing the outer rails 9*c*, 9*c* of the assemblies to the door 8.

The slide rail assemblies 9, 9 may be of any known type and each of them comprises a relative long outer rail 9*c* a relatively short inner rail arranged vis-a-vis with a ball retainer 9*b* interposed therebetween, said ball retainer retaining a plurality of steal balls 9*a*, 9*a*, 9*a*, . . . , in such a way that the outer rail 9*c* may freely slide and move relative to the inner rail 9*d*. A hinge 10 comprising a pair of hinge bodies 10*a*, 10*b* that are rotatable relative to each other around an axis 10*c* is fitted to the inner rail 9*d* of each of the slide rail assemblies 9, 9 by rigidly securing the hinge body 10*a* to the top of the rear side of the inner rail 9*d*.

A pair of longitudinal grooves 12, 12 are formed on the inner surface of the overhead door 8 to accommodate the respective slide rail assemblies 9, 9 and tension springs 11, 11, . . . running along the lateral sides of the slide rail assemblies.

Each of the tension springs 11, 11, . . . is held at an end to a spring hook 10*d* arranged at the top of the corresponding hinge 10 and secured at the other end to a spring hook 13 arranged at the lower end of the corresponding groove 12 so that the spring is normally held to a non-load condition.

The hinge body 10*b* of each of the hinges 10, 10 is rigidly secured to corresponding one of the recesses 7, 7 formed on the roof board 2 of the cabinet 1 by means of screws (not shown) so that consequently the door 8 may vertically rotate around the axes of the hinges 10, 10 and at the same time vertically slide with the outer rail 9*c* relative to the inner rail 9*d* as it is urged upward by the restoring force of the expanded tension springs 11, 11, . . .

Note that while not only the tension springs 11, 11, . . . but also the slide rail assemblies 9, 9 are housed in the grooves 12, 12 in the illustrated embodiment, the latter may be directly fitted to the inner surface of the overhead door 8 instead of being housed in the respective grooves 12, 12.

The overhead door 8 is additionally provided on the inner surface and near the lower edge thereof with a pair of brackets 16, 16, to which the respective proximal ends of a pair of support arms 14, 14 are pivotably secured. The distal ends of the support arms 14, 14 are rotatably fitted to respective rotary shafts 15, 15 that are by turn secured to the respective lateral walls 4, 4 at locations in the upper half of the walls. Thus, the overhead door may be rotated around the rotary shafts 15, 15 to move between a fully opened position and a fully closed position as shown in FIGS. 1 and 2.

The above embodiment may be so modified that a pair of dampers 17, 17 having respective main bodies 17*a*, 17*a* are fitted to the respective rotary shafts 15, 15 on the inner surfaces of the lateral walls 4, 4 by securing the main bodies to the walls as shown in FIG. 3. With such an arrangement, the distal ends of the support arms 14, 14 are rigidly fitted to the respective rotary shafts 15, 15 such that, when the overhead door is turned to its closed position, the door is made to move slowly and softly as the torque applied to the door is dampen by the dampers 17, 17.

Note that the dampers 17, 17 exert their damping effect only when the door 8 is turned downward to its closed position along arrow A shown in FIG. 2 and, when it is turned upward in the opposite direction along arrow B shown in FIG. 1, it can move lightly due to the restoring force of the springs (not shown).

The above embodiment may be further modified so that dampers 17, 17 are additionally provided with respective coil springs 18, 18.

Figure 4:
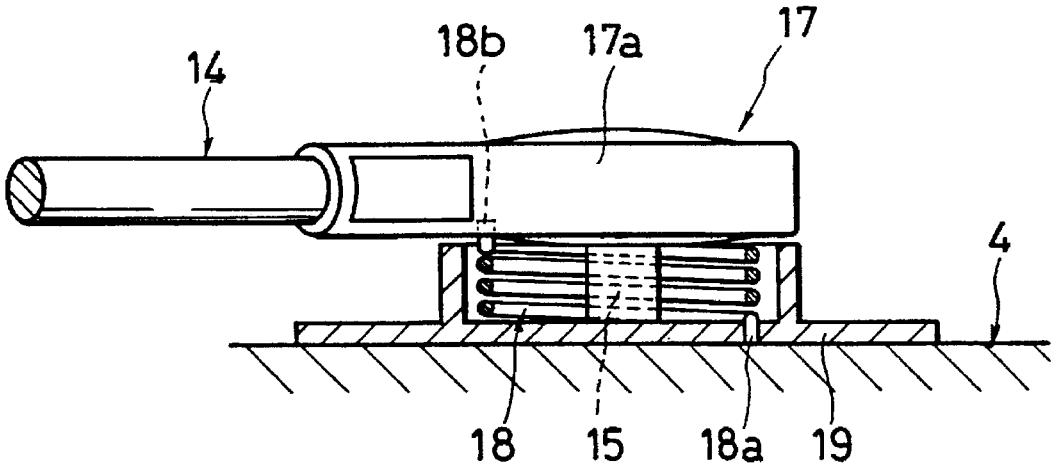
FIG. 4 is a partially torn out lateral view of a damper having a coil spring that can be used for the purpose of the invention.
Figure 5:
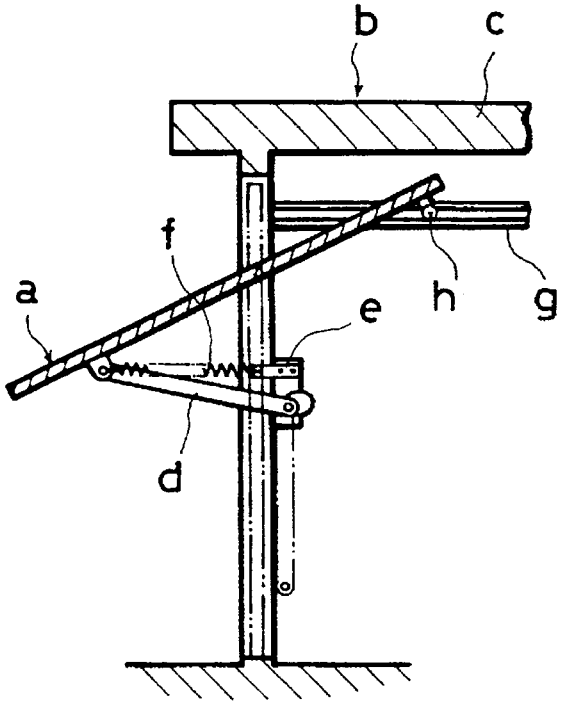
FIG. 5 (PRIOR ART)
FIG. 5 is a longitudinal sectional view of a conventional overhead door.

More specifically, referring to FIG. 4 showing the modified embodiment, the rotary shafts 15, 15 are fitted not directly to the respective lateral walls 4, 4 but to respective base boards 19, 19 that are rigidly bonded to the lateral walls 4, 4 and the support arms 14, 14 are linked to the respective main bodies 17*a*, 17*a* of the dampers 17, 17 in stead of securing the main bodies 17*a*, 17*a* to the respective inner surfaces of the lateral walls 4, 4 and the support arms 14, 14 to the respective rotary shafts 15, 15 as in the case of FIGS. 1 through 3 so that the main bodies 17*a*, 17*a* rotate round the respective rotary shafts 15, 15. Each of the coil springs 18, 18 is held at an end 18*a* thereof to the corresponding base board 19 and its other end 18*b* to the main body 17*a* of the corresponding damper 19.

With the above described arrangement, the coil springs 18, 18 are held at the opposite ends thereof to the respective rotary shafts 15, 15 and the respective main bodies 17*a*, 17*a* of the dampers so that they are wound further as the door is turned downward to its closed position and urges the door 8 upward along with the outer rail 9*c* due to their restoring force.

Thus, with this modified embodiment, the dampers 17, 17 exert their damping effect only when the overhead door 8 is turned downward from its open position down whereas the coil springs 18, 18 are wound further as the door 8 is turned downward so that their restoring force stored in them effectively operates to urge the door turn upward by way of the main bodies 17*a*, 17*a* of the dampers 17, 17 when the door is moved toward its open position.

[Advantages of the Invention]

As described above in detail, since the door is swingably supported by hinges and support arms so that it may freely move between a fully opened position and a fully closed position located above the roof board of the cabinet to which it is fitted and slidingly pulled forward for closing the door by means of slide rail assemblies, the door and the attachments do not constitute any obstacles and the space available within the cabinet is significantly increased.

When tension springs are arranged in respective grooves formed on the inner surface of the overhead door, they store energy in them as the door is pulled backward along with the slide rail assemblies as it is turned upward toward its open position so that, when the door is turned for closing, the tension springs exert the restoring force to counter the torque applied to the door by its own weight so that the door may be closed without requiring any significant effort to support it in order to avoid any bang from being produced on the part of the door. Additionally, since the tension springs are housed in the grooves arranged on the inner surface of the door and hence do not come out when the door is turned open, they do not affect the appearance nor give rise to any risk of pinching fingers when the door is operated for opening or closing.

When dampers are arranged on the respective lateral walls of the cabinet to alleviate the torque applied to the door by its won weight, the operation of closing the door is made soft and slow and free from any significant impact.

When dampers are used in combination with tension springs, the effect of alleviating the torque applied to the door by its won weight is improved to make the operation of closing the door softer and slower and completely free from any significant impact.

When, alternatively, dampers are used in combination with coil springs, the effect of the dampers of suppressing any bang that can be produced on the part of the door is improved by the resistance of the coil springs when the door is closed. Additionally, the effort required for the operation of opening the door can be significantly reduced by the restoring force of the coil springs so that the door can be opened with a minimal effort.

Finally, when dampers are used in combination with tension springs and coil springs, it would be apparent that the effect of suppressing any possible bang that can be produced on the part of the door is remarkably improved, whereas the door can be turned open with a minimal effort as the coil springs and the tension springs urge the door upward toward its open position.

What is claimed is:

1. An overhead door swingably secured to inner lateral wall surfaces of a cabinet by means of a pair of support arm/damper assemblies such that a damper of each of the assemblies is rigidly fitted to a corresponding lateral wall of the cabinet and a distal end of a support arm of each of the assemblies is secured to a rotary shaft of the damper while a proximal end is pivotally fitted to an inner surface of the door at a position close to a lower edge thereof, characterized in that the door is provided on the inner surface thereof with a pair of longitudinally arranged slide rail assemblies, each of said slide rail assemblies comprising a relatively long outer rail and a short inner rail arranged vis-a-vis the outer rail with a ball retainer interposed therebetween and pivotably secured at an upper end to a front edge of a roof wall of the cabinet by a hinge, so that the door can be swung open or closed as a combined effect of slewing and sliding motions and, when fully opened, the door is placed on the roof wall of the cabinet, that the door is also provided on the inner surface thereof with a number of longitudinal grooves, each of said grooves accommodating a tension spring having one end hooked to an upper end of a corresponding one of the hinges and another end hooked to a lower end of the groove, so that the upward motion of the outer rail and the door relative to the inner rail is restrained whereas downward motion of the outer rail and the door in relation to the inner rail is facilitated by the tension springs and that the damper of each of said short arm/damper assemblies is provided with a coil spring having one end hooked to the rotary shaft of the damper and another end hooked to a damper main body so that said coil spring is wound further when the door is moved down toward a closed position and urges the outer rail and the door upward relative to the inner rail.

2. An overhead door swingably secured to inner lateral wall surfaces of a cabinet by means of a pair of support arms such that a distal end of each of the support arms is rotatably secured to a corresponding lateral wall of the cabinet and a proximal end is pivotably fitted to an inner surface of the door at a position close to a lower edge thereof, characterized in that the door is provided on the inner surface thereof with a pair of longitudinally arranged slide rail assemblies, each of said slide rail assemblies comprising a relatively long outer rail and a short inner rail arranged vis-a-vis the outer rail with a ball retainer interposed therebetween and pivotably secured at an upper end to a front edge of a roof wall of the cabinet by a hinge, so that the door can be swung open or closed as a combined effect of slewing and sliding motions and, when fully opened, the door is placed on the roof wall of the cabinet and that the door is also provided on the inner surface thereof with a number of longitudinal grooves, each of said grooves accommodating a tension spring having one end hooked to an upper end of a corresponding one of the hinges and another end hooked to a lower end of the groove, so that the upward motion of the outer rail and the door relative to the inner rail is restrained whereas downward motion of the outer rail and the door relative to the inner rail is facilitated by the tension springs.

3. An overhead door swingably secured to inner lateral wall surfaces of a cabinet by means of a pair of support arm/damper assemblies such that a damper of each of the assemblies is rigidly fitted to a corresponding lateral wall of the cabinet and a distal end of a support arm of each of the assemblies is secured to a rotary shaft of the damper while a proximal end is pivotably fitted to an inner surface of the door at a position close to a lower edge thereof, characterized in that the door is provided on the inner surface thereof with a pair of longitudinally arranged slide rail assemblies, each of said slide rail assemblies comprising a relatively long outer rail and a short inner rail arranged vis-a-vis the long outer rail and a short inner rail arranged vis-a-vis the outer rail with a ball retainer interposed therebetween and pivotably secured at an upper end to a front edge of a roof wall of the cabinet, so that the door can be swung open or closed as a combined effect of slewing and sliding motions and, when fully opened, the door is placed on the roof wall of the cabinet.

4. An overhead door swingably secured to inner lateral wall surfaces of a cabinet by means of a pair of support arm/damper assemblies such that a damper of each of the assemblies is rigidly fitted to a corresponding lateral wall of the cabinet and a distal end of a support arm of each of the assemblies is secured to a rotary shaft of the damper while a proximal end is pivotably fitted to an inner surface of the door at a position close to a lower edge thereof, characterized in that the door is provided on the inner surface thereof with a pair of longitudinally arranged slide rail assemblies, each of said slide rail assemblies comprising a relatively long outer rail and a short inner rail arranged vis-a-vis the outer rail with a ball retainer interposed therebetween and pivotably secured at an upper end to a front edge of a roof wall of the cabinet by a hinge, so that the door can be swung open or closed as a combined effect of slewing and sliding motions and, when fully opened, the door is placed on the roof wall of the cabinet and that the door is also provided on the inner surface thereof with a number of longitudinal grooves, each of said grooves accommodating a tension spring having one end hooked to an upper end of a corresponding one of the hinges and another end hooked to the lower end of the groove, so that the upward motion of the outer rail and the door relative to the inner rail is restrained whereas downward motion of the outer rail and door relative to the inner rail is facilitated by the tension springs.

5. An overhead door swingably secured to inner lateral wall surfaces of a cabinet by means of a pair of support arm/damper assemblies such that a damper of each of the assemblies is rigidly fitted to a corresponding lateral wall of the cabinet and a distal end of a support arm of each of the assemblies is secured to a rotary shaft of the damper while a proximal end is pivotably fitted to an inner surface of the door at a position close to a lower edge thereof, characterized in that the door is provided on the inner surface thereof with a pair of longitudinally arranged slide rail assemblies, each of said slide rail assemblies comprising a relatively long outer rail and a short inner rail arranged vis-a-vis the outer rail with a ball retainer interposed therebetween and pivotably secured at an upper end to a front edge of a roof wall of the cabinet by a hinge, so that the door can be swung open or closed as a combined effect of slewing and sliding motions and, when fully opened, the door is placed on the roof wall of the cabinet and that the damper of each of said short arm/damper assemblies is provided with a coil spring having one end hooked to the rotary shaft of the damper and another end hooked to a damper main body so that said coil spring is wound further when the door is moved down toward a closed position and urges the outer rail and the door upward relative to the inner rail.

* * * * *